United States Patent [19]

Haberhauer et al.

[11] Patent Number: 4,826,351

[45] Date of Patent: May 2, 1989

[54] GRID PLATE OF PLASTIC MATERIAL

[75] Inventors: Karl Haberhauer, Gruenstadt; Klaus D. Feyerabend, Rimbach; Bruno Heitzmann, Bad Duerkheim; Alfred Lieberenz, Ludwigshafen; Harry Schimmel, Gruenstadt, all of Fed. Rep. of Germany

[73] Assignee: Spiess Kunstoff-Recycling GmbH & Co., Fed. Rep. of Germany

[21] Appl. No.: 115,979

[22] Filed: Nov. 2, 1987

Related U.S. Application Data

[63] Continuation-in-part of Ser. No. 934,097, Nov. 24, 1986, abandoned.

[30] Foreign Application Priority Data

Nov. 22, 1985 [AT] Austria ..... 3413/85

[51] Int. Cl.[4] ..... E01C 5/22

[52] U.S. Cl. ..... 404/35; 404/41; 52/588

[58] Field of Search ..... 404/35, 41; 52/588

[56] References Cited

U.S. PATENT DOCUMENTS

| | | | |
|---|---|---|---|
| 1,509,659 | 9/1924 | Luchich et al. | 404/41 |
| 2,918,151 | 12/1959 | Kennedy | 52/588 |
| 3,875,714 | 4/1975 | Nayler et al. | 52/588 X |
| 4,167,599 | 9/1979 | Nissinen | 404/41 X |

*Primary Examiner*—Jerome W. Massie
*Assistant Examiner*—Matthew Smith
*Attorney, Agent, or Firm*—Barnes & Thornburg

[57] ABSTRACT

A grid plate of plastic material, with a rough, slippage-impairing top side and a rib-reinforced bottom side. The individual grid plates are kept together by a lockable, but again disconnectable, plug-in connection. The grid plates serve as fastening elements for parking places, road embankments, road ramps, and the like.

33 Claims, 3 Drawing Sheets

GRID PLATE OF PLASTIC MATERIAL

BACKGROUND AND SUMMARY OF THE INVENTION

This application is a continuation-in-part of U.S. application Ser. No. 934,097, filed Nov. 24, 1986, abandoned.

The present invention relates to a grid plate of plastic material, especially of recycled plastic material, with a rough slippage-preventing top side and a rib-reinforced bottom side, which is adapted to be used as fastening element for parking places, road embankments, ramps, etc., and which includes a plug-in connection that is adapted to be locked together and connects the laid-out grid plates with each other, yet is again disconnectable.

Lattice plates of plastic material are known already in various constructions. The connection to adjacent already installed grid plates consists in one case of a spring and groove. Apart from the fact that they warp over the entire length after the mold opening during the cooling off and are no longer adapted to be slid one into the other in a simple manner, the groove may become clogged up with soil during storage over longer period of time or with an improper emplacement, as a result of which a workman-like proper and rapid emplacement is rendered considerably more difficult. Furthermore, during the occurrence of strong horizontal forces, a displacement of the spring and groove cannot be precluded over longer periods of time. The emplaced grid plates become disengaged from their connection and form a source of danger.

In another known grid plate, smooth webs projecting out of the grid plate are provided for the mutual connection which engage into corresponding apertures of the counterpart. The grid plates are laid on the prepared ground during the installation and are slid with the webs into the apertures of the counterplate. Soil thereby also gets into the apertures which become clogged up as a result thereof, and render more difficult, the sliding of the grid plates one into the other. Frequently, this operation has to be assisted with hammer impacts. Also with these plates, a disconnection of the engagement by horizontal forces cannot be avoided, especially when narrow embankments, as, for example Autobahn ramps, are to be fastened.

It is also desirable to provide different placement patterns of adjacently placed grid plates. The prior known devices do not provide for locking arrangements on all sides of the grid plates in order to permit different patterns of arrangements of interlocked grid plates.

It is the object of the present invention to provide a grid plate which can be readily emplaced, locks itself during the emplacement operation with the adjacent plate and can be unlocked again in a simple manner in case of need, which precludes a clogging up of the locking parts during the emplacement and which by its special form is simple and relatively inexpensive in manufacture.

It is another object of the present invention to provide a grid plate which can be locked in different patterns with respect to adjacent grid plates. According to certain preferred embodiments, these patterns can include rows, composite offsetting grid plates, domino shapes or herringbone patterns and other possible configurations.

These objects are achieved by providing a grid plate of plastic material having a rough slippage-preventing top side and a rib-reinforced bottom side. The grid plate is adapted to be emplaced as a fastening element for parking places, road embankments, ramps, and the like. The grid plate includes a three dimensional grid plate having an upper face, a lower section opposite the upper face, and at least three sides around the perimeter extending from the upper face to the lower face. The grid plate also includes plug-in connecting elements adapted to be locked together and again disconnectable for connecting together emplaced grid plates including at least one insertable connecting web element projecting out of at least two side walls of the grid plate in given positions on a first half of each side and extending substantially parallel to the upper face and extending out beyond the upper face. The connecting web elements each having a free end angularly bent hook-shaped into a half-hinge. At least one horizontal wall aperture element is provided in the at least two side walls of the grid plate which include connecting web elements in positions on a second half region of each side for engaging connecting web elements of adjacently arranged grid plates. The wall aperture elements each have an upper connecting web element, which in conjunction with the upper grid plate wall, form another hook-shaped hinge half for engaging with adjacent connecting elements projecting from adjacent grid plates.

According to advantageous features of certain preferred embodiments of the invention, the grid plate is a rectangular box shape having a rectangular upper face and four sides leading to a lower section. On a first side, at least one insertable connecting web element is disposed and on an opposing parallel second side wall at least one wall aperture element is provided. On the two walls perpendicular to the first two side walls, a first half section closer to the side wall including the connecting web elements includes at least one connecting web element extending therefrom. On the remaining half of the side walls perpendicular to the first and second side walls, at least one wall aperture element is provided. These wall aperture elements are arranged for engaging connecting web elements of adjacently arranged grid plates in given positions.

Using the grid plates of the present invention, a large variety of possible engaged patterns of grid plates are available. Specific examples of the patterns possible during placing include directly aligned rows, composite offsetting, and domino shapes or herringbone patterns. Any number of the grid plates can be engaged side-by-side, end-to-end, or end-to-side. The present invention provides an especially stable pattern of engaged adjacent grid plates all connected and engaged to one another. It is also highly advantageous to be able to provide the variety of patterns possible with the present inventive grid plates.

According to other advantageous features of certain preferred embodiments of the invention, the opposing parallel side walls which have both connecting web elements and wall aperture elements have connecting web elements and wall apertures in approximately identical positions from one perpendicular side wall to the other perpendicular side wall.

The connecting webs arranged at a side in the upper area of the grid plate serve for the mutual anchoring which are, in certain preferred embodiments, angularly bent off at the free end hook-shaped in the direction toward the top side of the grid plate whereas a wall aperture is provided in the same position in an oppositely disposed side wall of an adjacent grid plate for each connecting web. The connecting webs of the grid plates to be emplaced are therefore adapted to be inserted or plugged-in into the wall apertures of the other already emplaced grid plate in such a manner that the grid plate to be emplaced is brought into an inclined position of about 30° to 45°. Only in this inclined position can the connecting webs be introduced into the wall apertures without thereby contacting the ground.

Only after the insertion, the grid plate is pivoted into the emplacement or installation plane and rests on the ground whereby the connecting webs are locked together in the wall apertures. The thus-locked-together plug-in connection can be disconnected again in a simple and easy manner during any subsequent desired disassembly in that the grid plate which had been installed last is again lifted into the inclined position, whereupon the same can be again removed by simply pulling it out.

Further, the favorable shape configuration requires no laid-in keys or spring-coupling keys for the wall apertures, and the grid plate can be easily removed from the mold.

According to other advantageous features of certain preferred embodiments of the present invention, the hook-shape angularly bent portion of the connecting webs may point in the direction toward the top side of the grid plate. This offers the advantage that the grid plate to be newly emplaced can be introduced with the connecting webs into the wall apertures only in an inclined position and with a lifted wall aperture side and in that after a subsequent folding-down of the grid plate into the emplacement plane, the hook or hooks engage hinge-like in the locking wall.

According to certain embodiments, the wall apertures may be constructed rectangularly shaped and may be matched in the dimensions to the cross section of the insertable connecting web, as a result of which the mold is considerably simplified.

In certain preferred embodiments, the connecting webs may be so dimensioned in length up to the hook-shaped angularly bent portion that a freedom of movement of about 15 mm between adjacent grid plates between one another is permitted. Therefore, the adjacent plate can be moved against one another, out 15 mm from one another or angled from one another. As a result thereof, shrinking and warping after the mold opening of the grid plates can be compensated. Additionally, the possibility is provided thereby to install the grid plates also in a relatively flat circular arc.

Furthermore, according to advantageous features of certain preferred embodiments, the side walls with the connecting webs may include a continuous or uninterrupted cover strip, as a result of which the gap between two adjacent grid plates is covered off.

In certain preferred embodiments, the connecting webs may be arranged directly underneath the cover strip and may be formed-on at the same. As a result thereof, the connecting webs are considerably shorter in the free length and have with the same cross section a considerably higher resistance movement against forces acting on the same. Additionally, the connecting webs cannot be quite as easily broken out of the wall.

In other advantageous features according to certain preferred embodiments of the invention, the side wall may be offset step-shaped in the downward direction within the area of the wall apertures starting from the top side of the grid plate whereby the first step is constructed as abutment for the hook-shaped angularly bent ends of the connecting webs. These features effect a further simplification of the mold.

In certain preferred embodiments, the second step in conjunction with the cover strip may cover off the gap between adjacent grid plates.

In certain preferred embodiments, the wall apertures may be placed into the second step side. The connecting webs are thereby embedded all around by the four sides of the wall apertures. The top side is covered off by the wall part serving as abutment, the left and right side by the wall part extending parallel thereto, and the lower side by the wall portion directed toward the same. The connecting webs thereby receive a particularly good support and guidance whereby at the same time the wall apertures are well covered off.

It is also contemplated that the connecting webs together with the wall apertures as well as the bottom-side ribs may be so arranged that the grid plates can be divided into two halves. It is possible thereby to manufacture with a single mold rectangular as also square grid plates. The square grid plates can be used as starting pieces during the emplacement in a mutually offset form. In the same manner narrow ramps, such as, for example, Autobahn ramps, can also be secured therewith.

After the emplacement, the grid plates are shaken into the soft underground (loose sand), i.e., by a vibratory motion. The hollow spaces at the bottom side of the grid plates thereby fill themselves with soil.

Of course, within the scope of the present invention, the free ends of the connecting webs may also be angularly bent hook-shaped laterally or downwardly, whereby in the former case, the grid plate has to be displaced laterally for the mutual locking engagement. Also, according to certain preferred embodiments, a different portion of the connecting webs on each grid plate can be bent hook-shaped in different directions.

According to certain preferred embodiments, the first side wall connecting webs are angularly bent hook-shaped downwardly and the perpendicular side wall connecting webs are angularly bent hook-shaped upwardly.

Other objects, advantages and novel features of the present invention will become apparent from the following detailed description of the invention when considered in conjunction with the accompanying drawings.

FIGS. *6a–6e* are schematic views of certain contemplated patterns of adjacently arranged grid plates.

Figure 7:
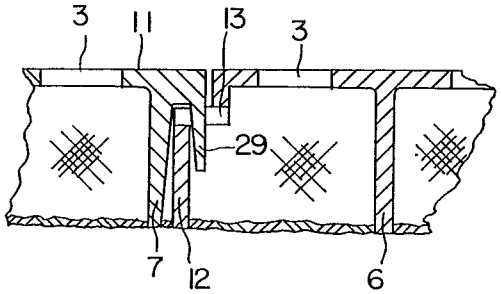

FIG. 7 is a partial cross-sectional view which illustrates the insertion of connecting webs having free ends directed downwardly.

DETAILED DESCRIPTION OF THE DRAWINGS

Figure 1:
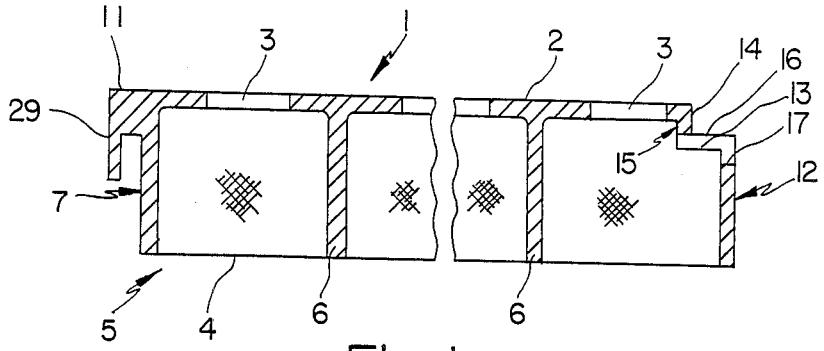
FIG. 1 is a cross-sectional view through a grid plate in accordance with the present invention.
Figure 2:
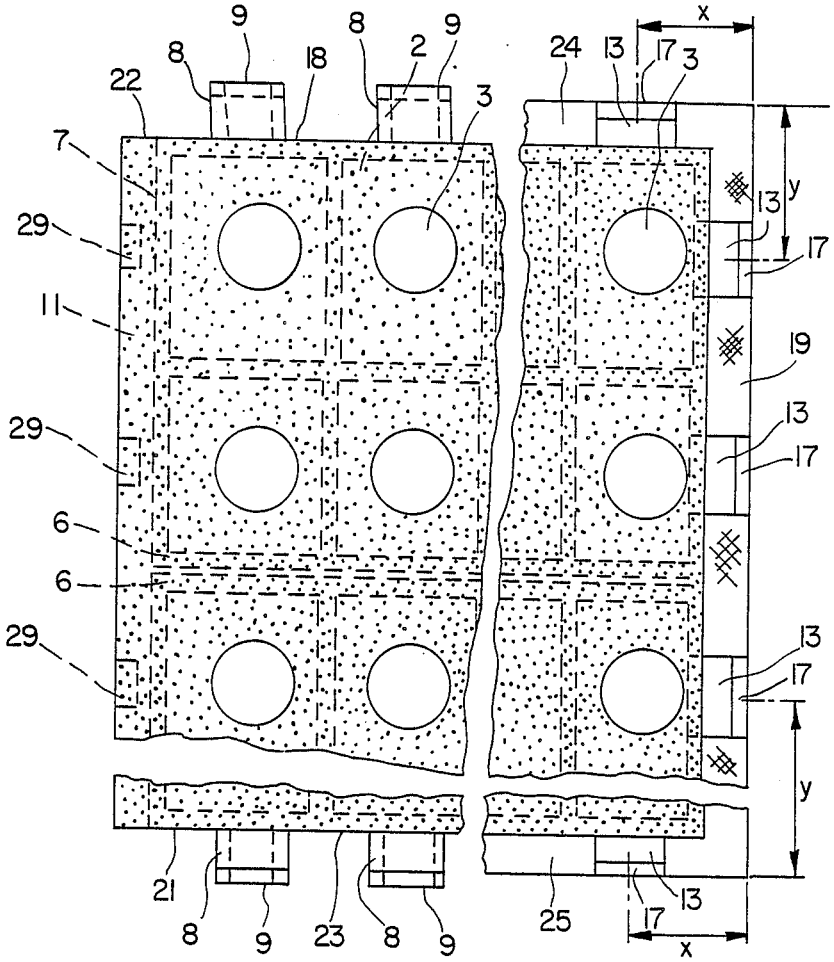
FIG. 2 is a partial top plan view of the grid plate in accordance with the present invention.

Referring now to the drawings wherein like reference numerals are used throughout the various views to designate like parts, as can be seen from the various figures, the top or upper face 2 of the grid plate generally designated by reference numeral 1 has a rough, slippage-impairing surface which is interrupted by apertures 3. The apertures 3 permit a grass growth of the ground 4 covered by the grid plates. A ribbing 6 is provided at a bottom side generally designated by reference numeral 5, which imparts the necessary reinforcement to the grid plate 1 and serves for anchoring in the ground. Connecting webs 8 are arranged at a first side wall 7 which at the free ends 9 thereof are angularly bent off hook-shaped. In certain preferred embodiments, these free ends 29 are bent toward the bottom side 5 (FIGS. 1, 2 and 7). However, in certain preferred embodiments, the free ends 9 are bent in the direction toward the top side 2. In order to avoid a material accumulation within this area, the connecting webs 8 are constructed of U-shape 10. The connecting webs 8 are additionally formed-on at a continuous cover strip 11 which extends over the entire length of the grid plate 1.

The oppositely disposed second side wall 12 is offset step-shaped toward the bottom side 5 and includes wall apertures 13 in the same position as the connecting webs 8. The wall apertures 13 correspond with the cross section of the connecting webs 8. The stepping-off part of the second side wall 12 is constructed in such a manner that the first step provides an abutment generally designated by reference numeral 15 for the hook-shaped angularly bent ends 9 of the connecting webs 8. The step side 16 which is parallel to the top side 2 is covered off by the cover strip 11 when an adjacent grid plate is attached. However, it also serves for the lateral guidance and support of the connecting webs 8 which additionally rest on the lower surface 17 of the wall apertures with emplaced grid plates 1.

As shown in FIG. 2, parallel third and fourth side walls 18 and 21 are disposed perpendicular to the first and second side walls 7 and 12. These side walls are provided with apertures and connecting webs to provide the unique variety of possible adjacent alignment patterns and stability of engaged adjacent grid plates. A symmetrical placement of of the location of the apertures 13 (X, Y) are schematically depicted in FIG. 2. These side walls are split into identical first half sections 22, 23 and second half sections 24, 25 divided by a separating line shown as a dotted line 26 (see FIGS. **6*b*–6*e*). The first and second grid plate half sections formed by the separating line 26** are designated in the drawing figures as A and B, respectively.

The first half sections 22, 23 of the third and fourth side walls 18 and 21, include extending connecting webs 8 which correspond to the connecting webs 8 extending from the first wall 7, and likewise have free ends 9 angularly bent off hook-shaped. The direction of the free end bend can be the same as the first side wall connecting webs, or in certain preferred embodiments the direction of the bend of the third and fourth side wall connecting webs is opposite to the first side wall connecting webs. In certain preferred embodiments, the first side wall connecting webs are bent downwardly and the third and fourth side wall connecting webs are bent upwardly. Further, in order to avoid a material accumulation within this area, the connecting webs 8 are constructed of U-shape 10.

The second half sections 24, 25 of the third and fourth walls 18 and 21 have wall apertures 13 corresponding to the structure of the wall apertures in the second wall 12. Connecting webs 8 on the third and fourth walls 18 and 21 extend out from the third and fourth walls in identical positions. Each corresponding third and fourth wall connecting web 8 is spaced an approximately identical distance from the first wall 7. Likewise, each corresponding third and fourth wall aperture is spaced an approximately identical distance from the second wall 12. Further, the apertures and the connecting webs of each first and second side wall are located in identical mirror positions with respect to each half of the third and fourth side wall such that the connecting webs of the first side wall 7 will align and engage properly when aligned adjacent to wall apertures of the third or fourth side walls 18 and 21, and such that the wall apertures of the second side wall 12 will align and engage properly when aligned adjacent to connecting webs of the third or fourth side walls 18 and 21.

Figure 6A:
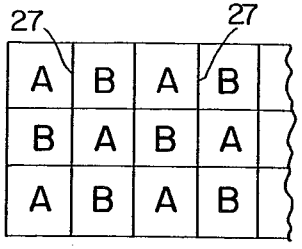
Figure 6B:
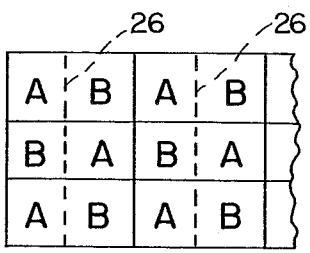
Figure 6C:
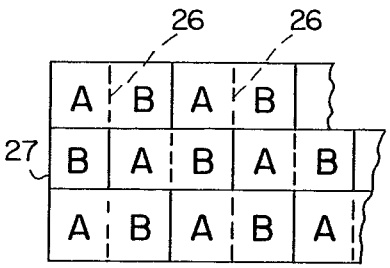
Figure 6D:
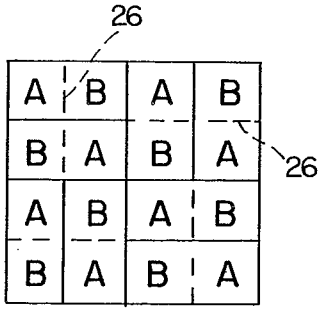
Figure 6E:
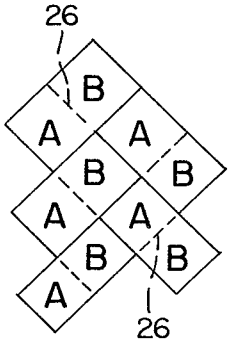

Further, the grid plates can be split along the separating line 26 to form a side wall 27 on each half not including the connecting webs or the wall apertures (see FIGS. **6*a* and 6*c*). This side wall can be used for border areas in which there are no adjacently attached grid plates or used for square patterns (see FIG. 6*a*). Further, these half sections are useful in forming borders for offset patterns (see FIG. 6*c***).

As can be seen in FIG. 2, the ribbing 6 at 28 can also be constructed in the grid plate perpendicular to separating line 26 such that the grid plate 1 can be divided into longitudinal sections. The parting line 26 can similarly be formed by ribbing in the middle of the guide plate between opposing first and second sides 7 and 12.

Figure 3:
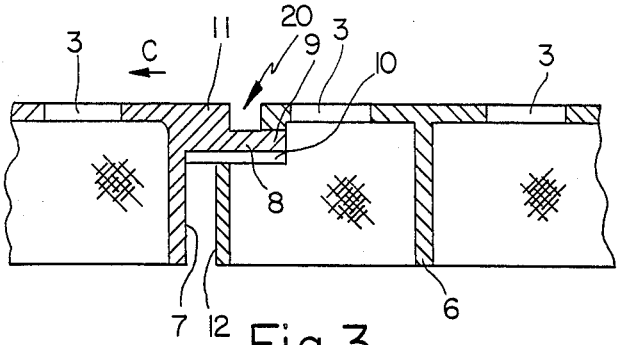
FIG. 3 is a partial cross-sectional view through locked-together grid plates in the pulled-out condition.
Figure 4:
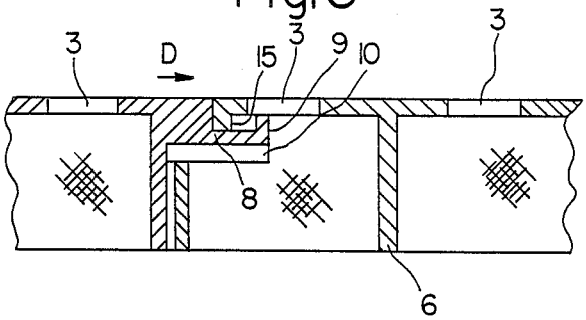
FIG. 4 is a partial cross-sectional view, similar to FIG. 3, through the locked-together grid plates in the normal, installed condition.

The connecting webs 8 may be so dimensioned in their length that the grid plates 1 have a freedom of movement of about 15 mm between one another. Shrinkages and warpings of the grid plates 1 can be easily compensated therewith. FIGS. 3 and 4 illustrate the freedom of movement between grid plates as FIG. 3 illustrates emplaced grid plates 1 in the pulled-out condition shown by arrow C, whereas FIG. 4 illustrates the grid plates in the normal, pushed together condition. This play entails the further advantage that the grid plates 1 can also be laid-out in a flat, circular arc.

Figure 5:
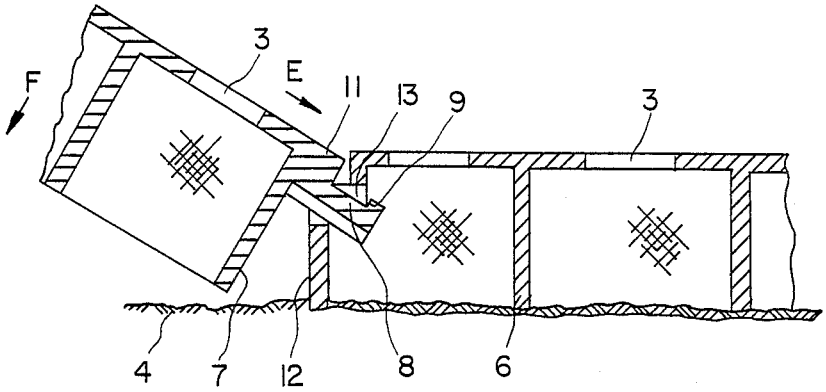
FIG. 5 is a partial cross-sectional view, similar to FIGS. 3 and 4, through grid plates which illustrate the insertion of the connecting webs into an already emplaced grid plate.

FIGS. 5 and 7 illustrate the emplacement of grid plates 1. As shown in FIG. 5, for the insertion of the connecting webs 8 having free ends 9 directed upwardly into the wall apertures 13, the grid plate side with the wall apertures 13 is brought into an inclined position of about 30° to 45° whereupon the connecting webs can be easily introduced into the wall apertures 13 shown by arrow E. After pivoting down the grid plate 1 from the inclined into the emplacement plane, respectively, as shown by arrow F on the ground surface 4, the hook-shaped angularly bent end 9 of the connecting webs 8 will become locked-up and will abut against the abutments 15. If once installed grid plates are again to be disassembled, then the locking engagement can be readily disconnected by lifting the grid plate 1 whereupon it can then be again taken out with the connecting webs 8 out of the wall apertures 13.

FIG. 7 shows the insertion of connecting webs having the free ends 29 directed downwardly. The free ends 29 of the connecting webs hook over an adjacent grid plate side wall 12 through wall apertures 13.

As shown in FIGS. *6a–6e*, the unique grid plate construction allows a wide variety of patterns to be formed when emplacing adjacent grid plates. A variety of shapes are possible due to the unique arrangement of the connecting webs 8 and the wall apertures 13. Therefore, as shown in FIG. *6a*, the grid plates can be arranged in a "half-shaped" pattern, in which the separating lines 26 split each grid plate in half. Therefore, a pattern results which has individual square sections adjacently aligned.

As shown in FIG. *6b*, the full grid plates can be placed adjacently in adjacent continuous rows. Adjacently aligned grid plates are attached to one another such that the first half A of the third and fourth side walls 18 and 21 are aligned adjacent to the second half B of the side walls 18 and 21 of an adjacently aligned grid plate. Further, the first and second side walls are aligned end-to-end. This pattern forms a continuous rectangular row shaped design.

As shown in FIG. *6c*, grid plates can be arranged in an offset form whereby adjacently aligned grid plates overlap one another such that again the first half A side wall of one row is attached to the second half B side wall of the adjacent row. Also, first side walls abut and engage second side walls. To provide square ends, the grid plate which would extend over the end can be broken at the separating line 26 as shown by the single square block in the middle row of FIG. *6c*.

Other unique patterns which are made possible by the unique construction of applicants' grid plate are shown in FIGS. *6d* and *6e*. As shown in these drawings, again, first half side wall sections A are aligned with second half side wall sections B of an adjacent grid plate. FIG. *6d* shows a parquet shape and FIG. *6e* shows a herringbone or domino shape.

Unique to all patterns of the inventive grid plate construction is that all side walls on the first half A of the grid plate include connecting webs, and all side walls of the second half B of the grid plate include corresponding wall apertures. Therefore, a stable engagement is provided between any adjacent alignment of any grid plate first half A side walls with any grid plate second half B side walls.

In all these patterns formed, all adjacently aligned grid plates are fastened to one another by the unique connecting webs associated with adjacent wall apertures. Thus, the aligned grid plates have increased stability as they are attached to one another through the half-hinge arrangement shown in FIGS. 3 and 4 on all adjacent sides of grid plates.

While we have shown and described only one embodiment in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

What is claimed is:

1. A grid plate of plastic material, having a rough slippage-preventing top side and a rib-reinforced bottom side, which is adapted to be emplaced as a fastening element for parking places, road embankments, ramps, and the like, comprising:

a three dimensional grid plate including an upper face, a lower section opposite said upper face, at least three sides around the perimeter extending from said upper face to said lower section, and plug-in connecting means adapted to be locked together and again disconnectable for connecting together emplaced grid plates including at least one insertable connecting web means projecting horizontally out of at least two side walls of the grid plate in given positions on a first half region of each side wall and extending out beyond the upper face, said connecting web means each having a free end angularly bent hook-shaped into a half-hinge, and at lease one horizontal wall aperture means being provided in an upper portion of said at least two side walls of the grid plate, which horizontal wall aperture means include connecting web means in positions on a second half region of each side wall for engaging respective insertable connecting web means of adjacently arranged grid plates in said given positions while permitting predetermined relative horizontal movement of the grid plates with respect to one another when in an installed position.

2. A grid plate according to claim 1, wherein said grid plate includes a rectangular upper face and a rectangular lower section, said side walls including a first and a second opposing side wall and a third and a fourth opposing side wall each perpendicular to the first and second side walls, each of said opposing third and fourth side walls including a first half region closer to said first side wall and including a second half region closer to said second side wall, said first half region of each of said third and fourth side walls and said first wall each including at least one of said connecting web means, said second half region of each of said third and fourth side walls and said second side wall each including said at least one horizontal wall aperture means.

3. A grid plate according to claim 2, wherein said third and said fourth side walls each have insertable connecting web means and wall aperture means in approximately identical positions from said first side wall to said second side wall, each of said insertable connecting web means of each of said third and fourth side walls being positioned an equal distance from said first side wall as a corresponding wall aperture means spaced from said second side wall.

4. A grid plate as in claim 3, wherein said first side wall includes only insertable connecting web means and said second wall includes only wall aperture means, said first wall connecting web means being spaced a distance from said third and fourth side walls equal to a distance said second side wall aperture means are spaced from said third and fourth side walls.

5. A grid plate as in claim 4, wherein said first wall insertable connecting web means free ends point in the direction toward said lower section and said third and fourth wall insertable connecting web means free ends point in the direction toward said upper face.

6. A grid plate according to claim 3, wherein said hook-shaped angularly bent portions of the free ends of said insertable connecting web means point in the direction toward said upper face of the grid plate.

7. A grid plate according to claim 3, wherein said wall aperture means are constructed substantially rectangularly shaped and are matched in their dimensions to a cross section of said insertable connecting web means.

8. A grid plate according to claim 7, wherein said insertable connecting web means are so dimensioned in length up to the hook-shaped angularly bent portion thereof that a freedom of movement of about 15 mm between one another is provided between engaged grid plates.

9. A grid plate according to claim 8, wherein said side wall regions with said insertable connecting web means include cover strip means extending uninterruptedly over substantially the entire length of the respective half region of the grid plate.

10. A grid plate according to claim 9, wherein said insertable connecting web means are arranged directly underneath said cover strip means and are formed-on at the same.

11. A grid plate according to claim 10, wherein said side wall regions including said aperture means are offset step-shaped in downward direction starting from the upper surface of the grid plate toward said lower section.

12. A grid plate according to claim 11, wherein said offset in conjunction with said cover strip means cover a gap between adjacent engaged grid plates.

13. A grid plate according to claim 12, wherein said offset includes a first step side extending from said upper face and a second step side extending up from said lower section, said wall aperture means being placed into said second step side.

14. A grid plate according to claim 13, wherein said insertable connecting web means together with said wall aperture means as well as said rib-reinforcement are so arranged that said grid plate is adapted to be divided into two halves.

15. A grid plate according to claim 3, wherein said grid plate is made from recycled synthetic resinous material.

16. A grid plate according to claim 6, wherein said wall aperture means are constructed substantially rectangularly shaped and are matched in their dimensions to a cross section of said insertable connecting web means.

17. A grid plate according to claim 16, wherein said insertable connecting web means are so dimensioned in length up to the hook-shaped angularly bent portion thereof that a freedom of movement of about 15 mm between one another is provided between engaged grid plates.

18. A grid plate according to claim 3, wherein said side wall regions with said insertable connecting web means include cover strip means extending uninterruptedly over substantially the entire length of the grid plate.

19. A grid plate according to claim 18, wherein said insertable connecting web means are arranged directly underneath said cover strip means and are formed-on at the same.

20. A grid plate according to claim 3, wherein said side wall regions including said aperture means are offset step-shaped in downward direction starting from the upper face of said grid plate.

21. A grid plate according to claim 20, wherein said offset in conjunction with said cover strip means cover a gap between adjacent engaged grid plates.

22. A grid plate according to claim 21, wherein said offset includes a first step side extending from said upper face and a second step side extending up from said lower section, said wall aperture means being placed into said second step side.

23. A grid plate according to claim 3, wherein said insertable connecting web means together with said wall aperture means as well as said rib-reinforcement are so arranged that said grid plate is adapted to be divided into two halves.

24. A grid plate according to claim 1, wherein said wall aperture means is bounded from above by an upper connecting web means which extends downward and forms a hook-shaped hinge half for engaging adjacent insertable connecting web means projecting from adjacent grid plates.

25. A grid plate according to claim 24, wherein a plurality of said insertable connecting web means are provided at a spacing from one another at each of said first half regions of said at least two side walls, and wherein a corresponding plurality of said horizontal wall aperture means are provided at the corresponding second half region of said side walls.

26. A grid plate according to claim 25, wherein said hook-shaped angularly bent portions of the free ends of said insertable connecting web means point in the direction toward said upper face of the grid plate.

27. A grid plate according to claim 26, wherein said wall aperture means are constructed substantially rectangularly shaped and are matched in their dimensions to a cross section of said insertable connecting web means.

28. A grid plate according to claim 27, wherein said insertable connecting web means are so dimensioned in length up to the hook-shaped angularly bent portion thereof that a freedom of movement of about 15 mm between one another is provided between engaged grid plates.

29. A grid plate according to claim 24, wherein said wall aperture means and said insertable connecting web means are configured so as to permit connection of said grid plate to an installed adjacent grid plate only upon tilting of said grid plate with its side remote from the installed grid plate raised and with subsequent insertion of said insertable connecting web means followed by pivoting of the grid plate to a position on the same plane as the installed grid plate to thereby lock the grid plates together.

30. A grid plate according to claim 25, wherein said wall aperture means and said insertable connecting web means are configured so as to permit connection of said grid plate to an installed adjacent grid plate only upon tilting of said grid plate with its side remote from the installed grid plate raised and with subsequent insertion of said insertable connecting web means followed by pivoting of the grid plate to a position on the same plane as the installed grid plate to thereby lock the grid plates together.

31. A grid plate according to claim 6, wherein said wall aperture means and said insertable connecting web means are configured so as to permit connection of said grid plate to an installed adjacent grid plate only upon tilting of said grid plate with its side remote from the installed grid plate raised and with subsequent insertion of said insertable connecting web means followed by pivoting of the grid plate to a position on the same plane as the installed grid plate to thereby lock the grid plates together.

32. A grid plate according to claim 31, wherein said wall aperture means are constructed substantially rectangularly shaped and are matched in their dimensions to a cross section of said insertable connecting web means.

33. A grid plate according to claim 32, wherein said insertable connecting web means are so dimensioned in length up to the hook-shaped angularly bent portion thereof that a freedom of movement of about 15 mm between one another is provided between engaged grid plates.

* * * * *